US005265289A

United States Patent [19]

Swiger et al.

[11] Patent Number: 5,265,289

[45] Date of Patent: Nov. 30, 1993

[54] CONVERTIBLE BABY COT AND TOTE BAG

[75] Inventors: Delia R. Swiger; A. J. Dolle, both of San Antonio, Tex.

[73] Assignee: McHarde, Inc., Tex.

[21] Appl. No.: 965,794

[22] Filed: Oct. 23, 1992

[51] Int. Cl.[5] ..... A47D 13/00; A47C 19/22; A47C 17/70; B65D 30/00

[52] U.S. Cl. ..... 5/111; 5/112; 5/655; 190/2; 383/4

[58] Field of Search ..... 5/111, 112, 114, 417, 5/420, 655; 190/1, 2; 383/4

[56] References Cited

U.S. PATENT DOCUMENTS 4,687,248 8/1987 Ross et al. ..... 383/4
4,736,825 4/1988 Belfi ..... 5/417
4,886,150 12/1989 Fitzsimmons ..... 5/420
4,947,498 8/1990 Van Boxtel ..... 5/114
5,035,013 7/1991 Bloom ..... 5/420

*Primary Examiner*—Alexander Grosz
*Attorney, Agent, or Firm*—Gunn, Lee & Miller

[57] ABSTRACT

A convertible baby cot/tote bag is provided having a rectangularly shaped main frame across which the baby supporting sheet is secured. The long sides of the main frame are medially pivoted about a horizontal axis to permit the main frame to be shifted from a horizontal cot position to a tote bag position wherein the main frame is divided into two vertically adjacent subframes. Sheet material is secured to the under surface of the baby supporting sheet so as to define pockets for the storage of baby accessories when the apparatus is to be used as a tote bag.

11 Claims, 3 Drawing Sheets

CONVERTIBLE BABY COT AND TOTE BAG

BACKGROUND OF THE INVENTION

1. Field of the Invention

The present invention relates to a bag or tote for baby supplies which additionally converts into a cot for sanitary support of the baby for diaper and/or clothes changing.

2. Background Information

As every mother knows, a baby requires constant care, wherever the baby is located. Providing the desired level of care necessitates use of baby care products such as diapers, powder, clothing, toys, bottles of milk, oil, and other items. The constant need for these baby care items makes it virtually impossible to transport an infant or baby without additional transport of the care products.

Recognizing the continuous need for this array of care items, parents or caregivers when travelling out of the home must carry some type of bag or tote for transporting and storing the items until needed.

Over the years, an assortment of "diaper bags" or totes have appeared on the market. Although identified as "diaper bags", these bags are also typically used to transport the mountain of other required baby care items. Overstuffed and overused, however, these bags, or their handles, frequently tear or rip.

Even those parents who opt to carry some type of tote or bag, however, are still burdened with concerns regarding the sanitary changing of the baby's diaper or clothing. The parents or caregivers of the child are frequently in a location that does not lend itself to sanitary conditions. Typically in public rest rooms, the parents must choose between lying the baby on a floor or on a counter top for changing, neither of which provide a sanitary support.

In an effort to solve the problem concerning sanitary baby changing conditions, many makers of standard diaper bags introduced a changing pad, usually with a plastic exterior. This pad typically comes with the diaper bag, folding into a shape that can be placed inside the diaper bag for transport with the other care items. Although the pad fits inside the diaper bag, the pad is usually extremely bulky and cumbersome, taking up much of the room needed for the other child care products.

Ironically, these pads often contribute to poor sanitary conditions as lack of space in the diaper bag typically forces the parent to leave the dirty diaper behind after changing instead of allowing for storage until proper disposal.

Other concerns remain even after the introduction of the portable changing pad. Although the child can be placed on the changing pad, avoiding direct contact with the floor or dirty counter top, many parents are still hesitant to place the pad on the dirty surface since the pad frequently comes into contact with other baby items after changing. Although many parents do choose to use the changing pad, it is often only for lack of a better alternative.

SUMMARY OF THE INVENTION

It is an object of Applicant's invention to provide a bag for transporting child care items which, by incorporating a convertible structural frame, permits the conversion of the bag, upon a simple movement of the frame to/for a child supporting cot.

It is also an object of Applicant's invention to provide a convertible diaper bag/changing cot which has storage pockets that provide ample space for transporting and storing the required child care items.

Another object of Applicant's invention is to provide a convertible diaper bag/baby cot which prevents contact between the material of the cot and any supporting surface for increased sanitation.

Applicant's invention is a convertible diaper bag/-baby cot which, through its unique frame structure allows the user to convert the diaper bag into a baby cot by a movement of the diaper bag handle. Applicant's invention consists of a rectangular frame which is transversely, medially pivoted between a closed position providing a bag frame, to an open position defining a cot frame. A child support sheet of flexible material is peripherally secured to the cot frame. Storage pockets are located on the underside of the transport sheet for transporting and storing the child care items. A dual action support leg is located at each end of the central frame. These dual action support legs act as a base for the diaper bag, and also provide supports for the ends of the frame when used as a baby cot. A center leg acts as the handle for the diaper bag, pivoting and locking into a 90° depending position relative to the frame structure when the frame is in the cot position.

Other objects and advantages will become apparent to those skilled in the art from the following detailed description, taken in conjunction with the annexed drawings.

DESCRIPTION OF PREFERRED EMBODIMENT

Figure 1:
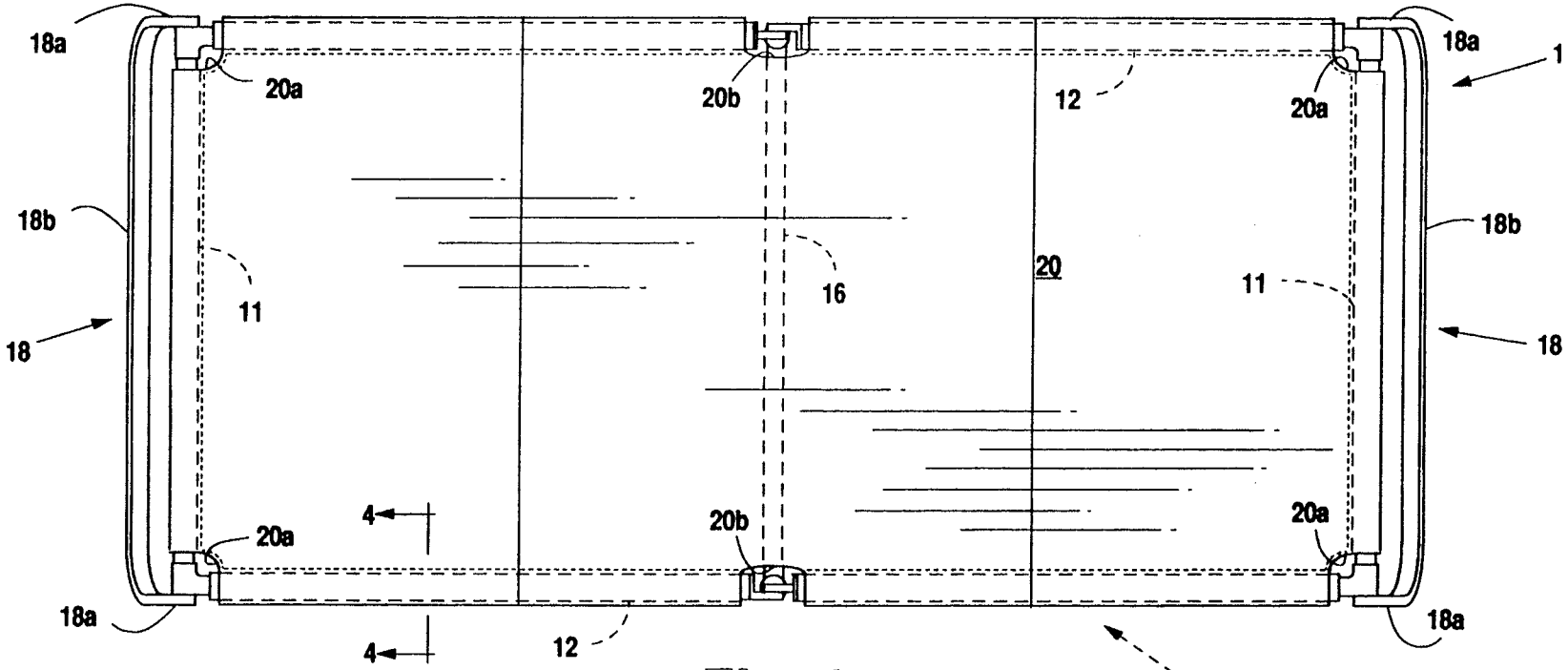
FIG. 1 is a plan view of the convertible diaper bag/-baby cot embodying this invention, shown in its open, baby cot position.
Figure 2:
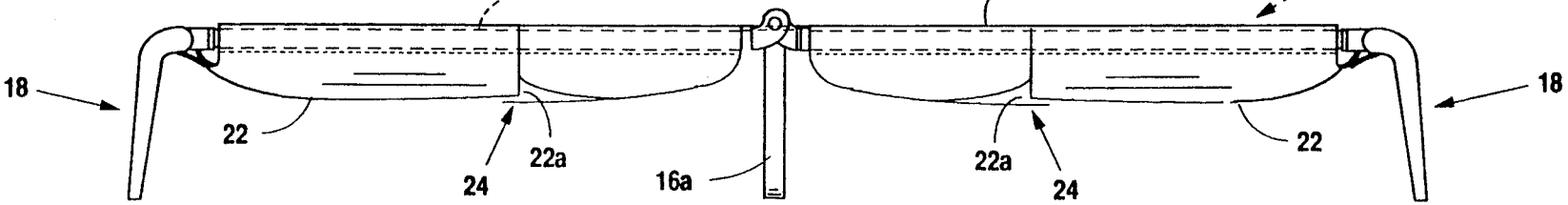
FIG. 2 is a side elevational view of FIG. 1.
Figure 4:
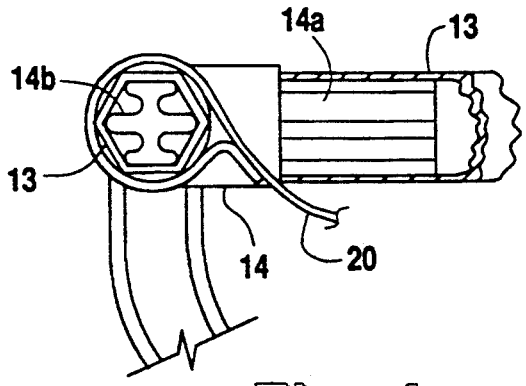
FIG. 4 is an enlarged scale sectional view taken along the plane 4—4 of FIG. 1.

Referring to FIGS. 1, 2 and 4, a convertible baby cot/tote bag 1 is shown in its baby supporting cot position. The convertible baby cot/tote bag 1 comprises a generally rectangular frame structure 10 having two short sides 11 and two long sides 12. A plurality of identical connectors 14 (later described) are provided for connecting the short sides 11 to the long sides 12. The short sides 11 and the long sides 12 preferably comprise identical elongated tubular elements 13 having a hexagonal cross-section, as shown in FIG. 4. Element 13 may have a circular or a cross-sectional configuration, if desired.

The short sides 11 preferably comprise a single length of the elongated tubular element 13 while the long sides 12 are each fabricated by the pivotal connection of the adjacent ends of two elongated tubular elements 13.

Figure 6:
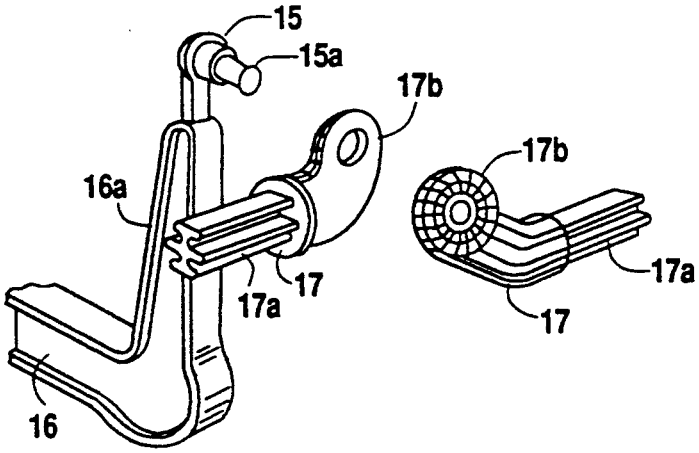
FIG. 6 is an exploded perspective view of connection of the handle support elements to the frame of the reversible diaper bag/baby cot.

As best shown in FIG. 2, the pivotal connection between the two elongated structural elements 13 of the long sides 12 respectively comprise pivot pins 15. Pivot pins 15 are integrally formed on the free ends of the arms 16*a* of a U-shaped handle element 16 formed of an injection molded plastic (see FIG. 6). The adjacent ends of the longitudinal structural elements 13 are each provided with a plug 17 having a shank portion 17*a* configured to be snugly inserted within the ends of the structural tubular element 13. The shank portion 17*a* is integrally formed with an upwardly curved planar projection 17*b*. Each planar projection 17*b* defines an aperture 17*c* which is snapped over a slightly enlarged end 15*a* provided on the pin 15. Thus, the tubular structural elements 13 of the two long sides 12 may be folded through a 90° angle about the pivot pin 15. In the normal position of the handle 16, when the rectangular frame is in its cot defining position, the sides of the curved flanges 17*b* are in abutment with the sidewalls of the arms 16*a* of the handle 16 as shown in FIG. 2. Thus, further pivotal movement of the two structural elements 13 forming each of the long sides 12 of the rectangular frame is prevented, and the handle 16 thus can form a solid support for the medial portions of the rectangular frame 10.

At each corner of the rectangular frame 10, a U-shaped, injection molded plastic support element 18 is securely mounted to the connecting element 14. In the cot defining position of the frame 10, the U-shaped supports 18 are in vertically depending relationship to the rectangular frame 10 and thus cooperate with the handle 16 in supporting the frame 10 in a horizontal position above a suitable support surface, such as a counter top.

The baby support surface is provided by a sheet of flexible material 20, such as canvas, or a plastic material having similar durability and non-resilient characteristics of canvas. The baby support sheet 20 is of generally rectangular configuration except that it is cut away at its four corners as indicated at 20*a* in order to provide clearance of the connectors 14 and at 20*b* to clear the pivots 17*a* and 17*b*. The sheet 20 is peripherally secured to the structural elements 13 forming the short and long sides 11 and 12 of the frame 10 as shown in FIG. 4, and is preferably secured in an untensioned condition. Thus, the sheet 20 provides a suitable support for changing diapers or clothing of a baby laid on the baby support sheet 20. It will be noted from FIG. 2, that the underside of the support sheet 20 does not come in contact with the supporting surface upon which the frame 10 rests.

Figure 3:
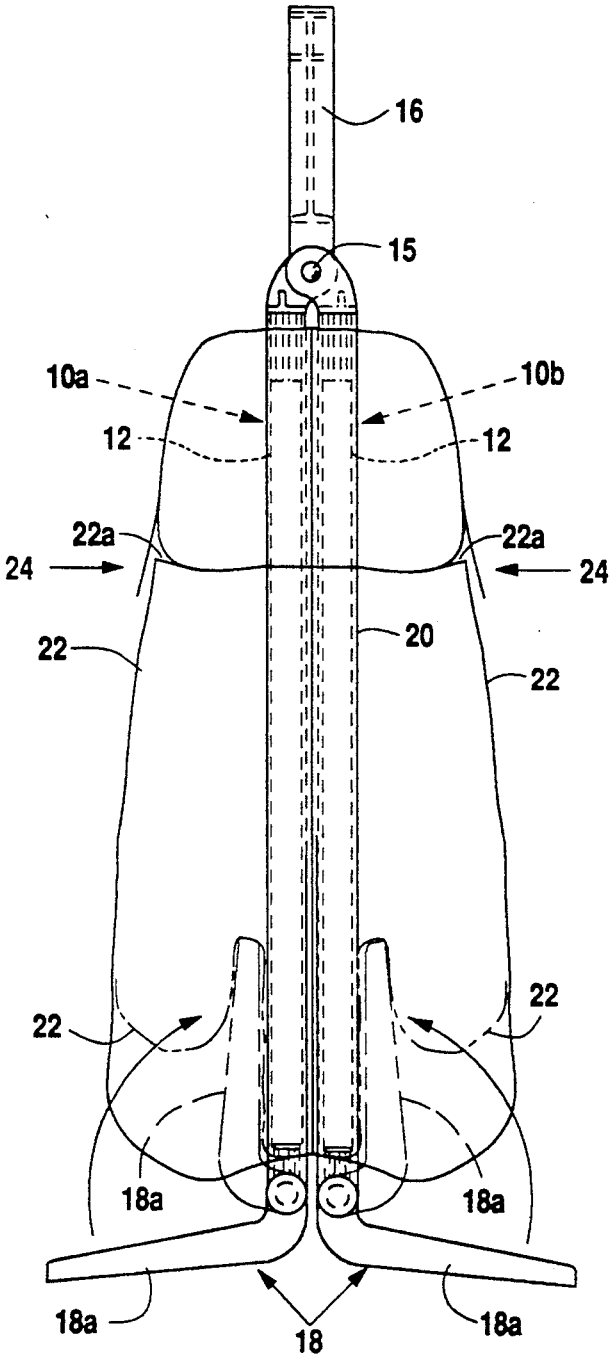
FIG. 3 is a side elevational view of the reversible diaper bag/baby cot, shown in its closed, upright diaper bag position.

When it is desired to convert the apparatus from its baby supporting cot position to a tote bag for baby accessories, it is only necessary to turn the frame 10 over and apply an upward force to the handle 16. Thus, as best shown in FIG. 3, such upward force will cause a folding of the long sides 12 of the rectangular frame structure 10 into a configuration wherein two sub frames 10*a* and 10*b* are disposed in vertically adjacent relationship as shown in FIG. 3. The end supports 18 are then disposed in a generally horizontal position. They may be left in that position during the usage of the unit 1 as a tote bag.

Figure 7:
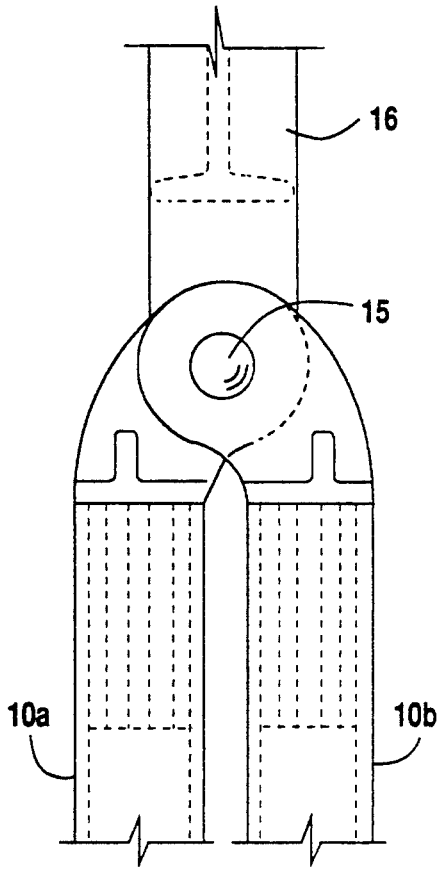
FIG. 7 is an enlarged scale elevational view of the medial pivotal connection of the two subframes of the convertible diaper bag/baby cot when positioned in the diaper bag configuration.

The tote bag conversion is completed through the provision of at least one flexible sheet element 22 secured on three sides to the underside of the baby support sheet surface 20, as shown in FIG. 3. Thus, when the frame 10 is folded to the position indicated in FIG. 3, the sheets 22 respectively form bags which may be filled with baby accessories through an open side 22*a*. If desired, such open side may be detachably closed by an overlapping flap with or without a buckle 24 cooperating strips of hook and loop fasteners (not shown) 24 or a zipper (not shown) provided along the side of each sheet 22 and on the bottom surface of the baby supporting sheet 20. The end supports 18 can thus provide support for the bottom portions of the bag defining sheets 22 and also permit the tote bag configuration to sit in an upright position. The position of the handle 16 relative to the two subframes 10*a* and 10*b* is clearly shown in the enlarged view of FIG. 7.

Figure 5:
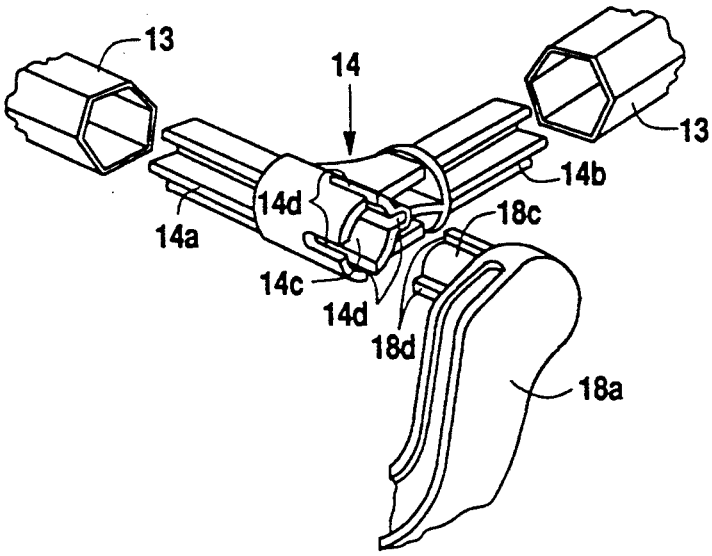
FIG. 5 is an exploded perspective view of the central pivot elements of the reversible diaper bag/baby cot.

There remains the detailed description of the corner connecting elements 14 which are best shown in FIG. 5. Each corner connector 14 is preferably formed of an injection molded plastic and defines two shank portions 14*a* and 14*b* projecting outwardly at right angles to each other which are snugly engageable within the bore of the adjacent end of the short side structural element 13 and the long side structural element 13.

Near the juncture of the shank portions 14*a* and 14*b*, a recess 14*c* is formed which is preferably in alignment with the axis of the structural element 13 of the respective short side 11. The walls of recess 14*c* are slotted at 90° intervals as indicate by slots or recesses 14*d*.

The support elements 18 are, as previously mentioned, of U-shaped configuration and having opposed arms 18*a* spaced apart a distance substantially equal to the total width of the short side 11 of the frame 10. The end of each arm 18*a* is provided with an integral plug portion 18*c* which has four peripherally spaced radial ribs 18*d* formed thereon which respectively cooperate with the recesses 14*d* in either of two 90° spaced positions. The ribs 18*d* and the slots 14*d* are dimensioned so as to produce a snug fit of these elements together. In one position, as shown in FIGS. 1 and 3, the connection is made so that the arm portions 18*a* of the support 18 are disposed in substantially perpendicular relationship to the frame 10, as shown in FIG. 1. If it is not desired to utilize the convertible baby cot/tote bag as a tote bag, the arms 18*a* can be pulled away from each other due to the resilience of the plastic material forming the base portion 18*b* of each support 18 and the arms 18*a* rotated 90° so as to engage the ribs 18*d* with a different 90° displaced set of slots 14*d*. This results in a very compact configuration of the entire apparatus as illustrated by the dotted line position of the arms 18*a* shown in FIG. 3 for convenient storage and transport.

Modifications of this invention will be readily apparent to those skilled in the art. It is preferred that the frame and support components of the aforedescribed structure be fabricated from a rigid plastic. It is, however, quite possible that the rectangular frame elements could be fabricated from a suitable metal, such as aluminum and the remainder of the components being fabricated from an injection molded rigid plastic.

Additionally, a plurality of bag defining sheets may be secured to the bottom face of the baby support sheet 20 if desired, in order to provide separation of diaper bags from clean clothes and food articles from all other articles. It should be particularly noted that the under surface of the baby support sheet 20, on which the bags 22 are formed, does not come in contact with any surface on which the apparatus is rested when in its cot defining position. Thus, no contamination will be picked up from the supporting surface.

Further modifications of the invention will be readily apparent to those skilled in the art and it is intended that all such modifications be included within the scope of the appended claims.

What is claimed and desired to be secured by Letters Patent is:

1. A convertible baby bag and cot comprising, in combination:

a rectangular frame formed by assemblage of a plurality of rigid elongated elements and having two long sides and two short sides; each of said long sides comprising two of said rigid elongated elements disposed in longitudinal alignment with the remote ends thereof respectively rigidly connected to the ends of one of said short sides;

means including a pin for pivotally connecting the adjacent ends of said two rigid tubular elements for relative movement about a central transverse axis of said rectangular frame, whereby said rectangular frame may be folded about said transverse axis from an elongated horizontal position to a vertical position wherein each of said long sides is divided into two side by side vertical subframes;

a generally rectangular sheet of flexible, substantially non-resilient material having its periphery secured to the periphery of said rectangular frame, thereby defining a baby supporting cot surface; and a plurality of rectangular sheets of flexible material secured to the bottom side of said baby supporting cot material to define pockets for baby items when said rectangular frame is folded to said vertical position 2. The apparatus of claim 1 wherein said pockets have an upwardly facing opening when said frame is folded into its vertical position.

3. The apparatus of claim 1 further comprising a U-shaped handle having a base portion of a length substantially equal to the width of said rectangular frame and two arm portions respectively formed on opposite ends of said base portion;

said arm portions each defining said pin element of said pivotal connection means to secure said handle in depending relation to said rectangular frame, whereby force on said handle away from said frame will fold said rectangular frame into said vertical position to form a carrying bag.

4. The apparatus of claim 3 wherein said pockets each have an upwardly facing opening when said frame is folded into its vertical position.

5. The apparatus of claim 3 wherein said pivotally connected adjacent ends of said two rigid elongated tubular elements have cooperating radial ratchet means for securing said ends in said aligned or said vertical positions.

6. The apparatus of claim 1 further comprising a pair of U-shaped supports, each support having a base portion of substantially the same width as said rectangular frame and arm portions at each end;

means for respectively securing said arm portions to the corners of said rectangular frame for pivotal movement between a position depending from said rectangular frame when said rectangular frame is in its horizontal elongated cot position, to a 90° displaced position wherein said base portions respectively abut said subframes of said rectangular frame in its folded bag forming position.

7. The apparatus of claim 1 further comprising a pair of U-shaped supports, each support having a base portion substantially the same width as said rectangular frame and arm portions at each end;

means for respectively securing said arm portions to corners of said rectangular frame for movement between a position depending from said rectangular frame when said rectangular frame is in its horizontal elongated cot position, to a 90° displaced position wherein said base portions abut said subframes of said rectangular frame in its folded bag forming position;

said rectangular frame in its non-folded position being supported above a support surface jointly by said U-shaped supports and said U-shaped handle.

8. A baby cot convertible into a carrying bag for baby supplies, comprising, in combination:

a generally rectangular frame having two long sides short sides rigidly interconnected between the ends of said long sides, said long sides being formed of two elongated frame elements;

a generally rectangular support sheet of flexible, substantially non-resilient material comprising top and bottom sides peripherally secured in covering relationship to said rectangular frame to define a baby supporting cot surface;

a pair of support members respectively secured in depending relation to said short sides of said rectangular frame, thereby positioning said support sheet above a supporting surface;

said two elongated frame members of each said long sides of said frame having their respective adjacent ends disposed in axial alignment when all sides of said frame are horizontally disposed in a cot defining position;

a U-shaped handle element having two arm portions spaced apart by a distance equal to the width of said rectangular frame;

said handle element being disposed beneath said rectangular frame when said frame is in its horizontal cot-defining position;

means on the free ends of said arm portions of said handle element respectively pivotally connecting said adjacent ends of said two long side frame elements for movement about a horizontal axis, whereby a perpendicular force applied to said handle element to pull said handle element away from said frame produces a folding of said rectangular frame into two adjacent vertical subframes; and at least one sheet of material secured to the bottom sides of said support sheet to define a pockets having an upwardly facing opening when said frame is medially folded into said two vertical subframes and supported by said handle element.

9. The apparatus of claim 8 wherein the vertical height of said support members is substantially equal to the height dimension of said handle element, whereby said handle element provides vertical support for the central portions of said rectangular frame when utilized as a cot.

10. The apparatus of claim 8 further comprising means for latching said handle element relative to said long sides of said rectangular frame in a position perpendicularly depending from said rectangular frame when said frame is in its said cot defining position.

11. A baby cot convertible into a carrying bag for baby supplies, comprising, in combination:

a peripheral frame having two long sides and two short sides rigidly interconnected between the ends of said long sides, said long sides being formed of two elongated frame elements;

a support sheet of flexible, substantially non-resilient material comprising top and bottom sides peripherally secured in covering relationship to said peripheral frame to define a baby supporting cot surface;

a pair of support members respectively secured in depending relation adjacent to said short sides of said rectangular frame, thereby positioning said support sheet above a supporting surface;

said two elongated frame members of each said long sides of said frame having their respective adjacent ends disposed in axial alignment when all sides of said frame are horizontally disposed in a cot defining position;

a U-shaped handle element having two arm portions spaced apart by a distance equal to the medial width of said peripheral frame;

said handle element being disposed beneath said peripheral frame when said frame is in its horizontal cot-defining position;

means on the free ends of said arm portions of said handle element respectively pivotally connecting said adjacent ends of said two long side frame elements for movement about a horizontal axis, whereby a perpendicular force applied to said handle element to pull said handle element away from said peripheral frame produces a folding of said peripheral frame into two adjacent vertical subframes; and sheet means secured to the bottom side of said support sheet defining storage pockets when said frame is medially folded into said two vertical subframes.

* * * * *